United States Patent [19]

Rodenchuk et al.

[11] 4,030,536

[45] June 21, 1977

[54] APPARATUS FOR CONTINUOUS CASTING OF METALS

[75] Inventors: William Simon Rodenchuk, Montreal; Anthony Garth Eccles, Oakville, both of Canada

[73] Assignee: Alcan Research and Development Limited, Montreal, Canada

[22] Filed: Nov. 3, 1975

[21] Appl. No.: 628,321

Related U.S. Application Data

[62] Division of Ser. No. 465,552, April 30, 1974, Pat. No. 3,933,192.

[30] Foreign Application Priority Data

Apr. 30, 1973 United Kingdom ..... 20553/73

[52] U.S. Cl. ..... 164/274; 164/280

[51] Int. Cl.[2] ..... B22D 11/08

[58] Field of Search ..... 164/83, 280, 274

[56] References Cited

UNITED STATES PATENTS

| | | | |
|---|---|---|---|
| 3,228,071 | 1/1966 | Schultz | 164/280 |
| 3,565,155 | 2/1971 | Vertesi et al. | 164/83 X |
| 3,667,534 | 6/1972 | Kanokogi et al. | 164/83 |

FOREIGN PATENTS OR APPLICATIONS

| | | | |
|---|---|---|---|
| 32,173 | 8/1972 | Japan | 164/273 |

*Primary Examiner*—Robert D. Baldwin
*Attorney, Agent, or Firm*—Cooper, Dunham, Clark, Griffin & Moran

[57] ABSTRACT

In the continuous casting of an ingot of rectangular cross-section, the formation of convexly curved surfaces on the wider faces of the ingot is avoided, along the full length of the ingot, by progressively increasing the gap at least between the mid-points of the longer sides of the rectangular mould, without substantially altering the gap between the ends of said sides, as the rate of advance of the ingot through the mould increases from a relatively low initial speed. The mould is cooled and coolant is applied directly to the surface of ingot emerging from the mould. In an apparatus for putting the above method into practice, means is provided for varying the curvature of the long side walls of the mould progressively during a casting operation by the application of a flexing force arranged symmetrically with respect to the mid-point of each of the long sidewalls, the ends of the said side walls being restrained from transverse movement.

8 Claims, 4 Drawing Figures

Figure 1:
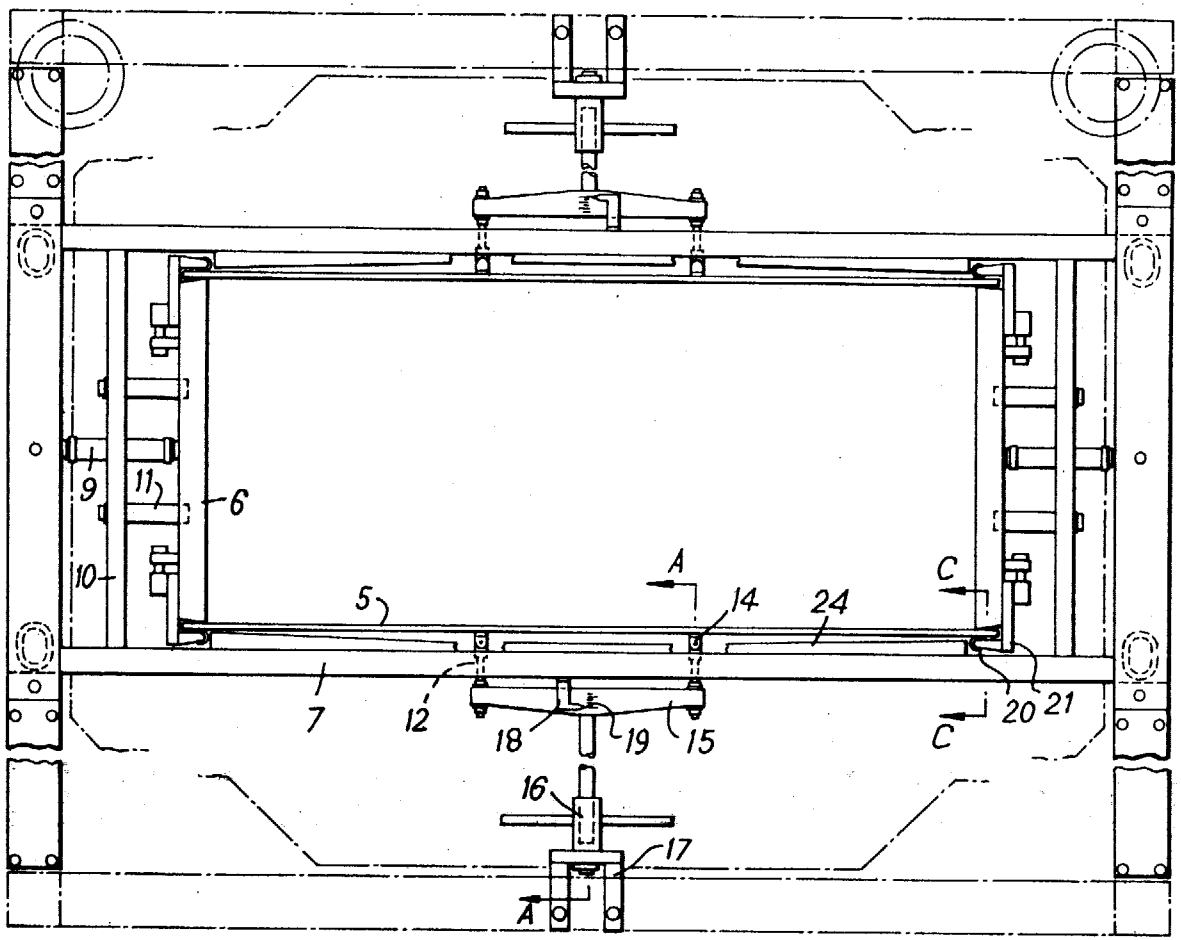

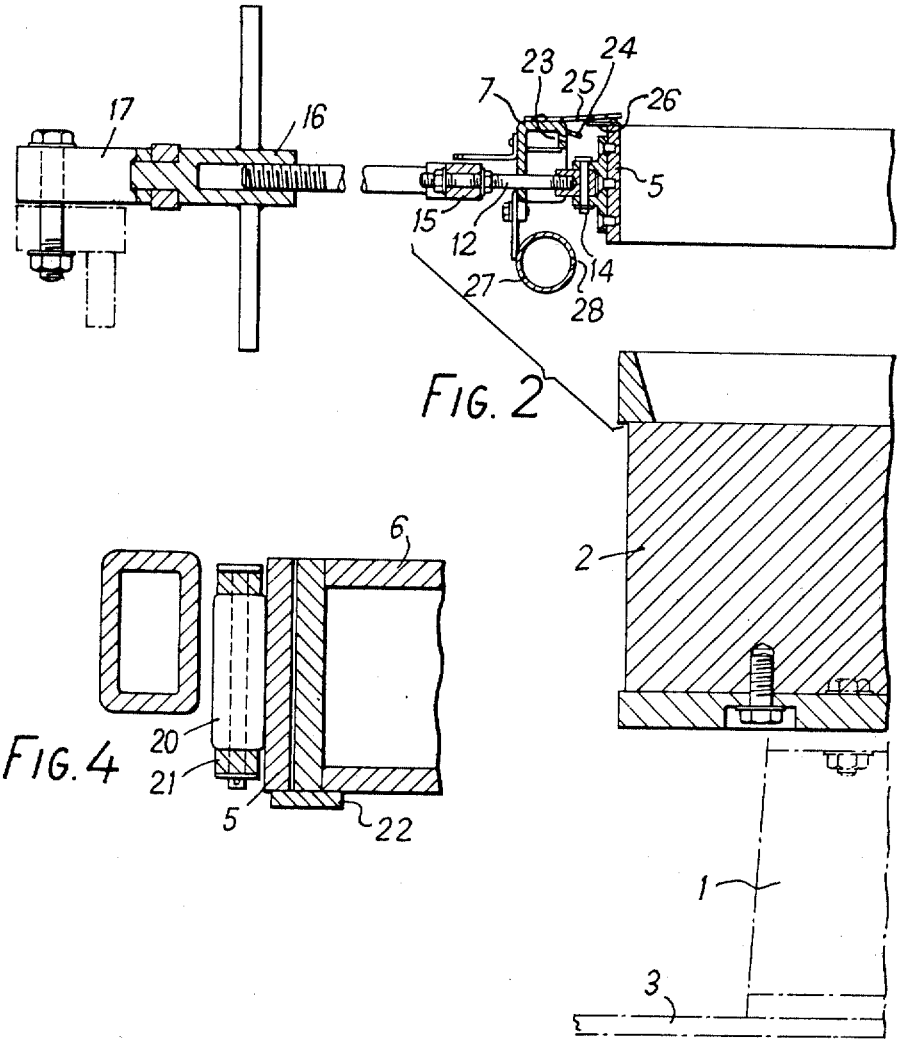
FIG. 2
FIG. 4
FIG. 3
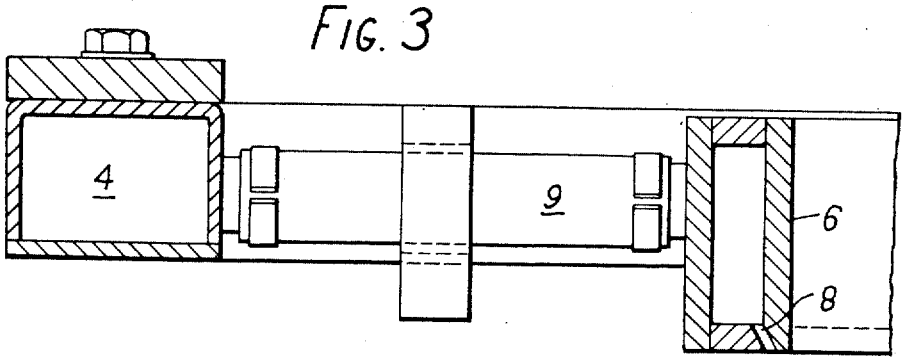

APPARATUS FOR CONTINUOUS CASTING OF METALS

This is a division, of application Ser. No. 465,552 filed Apr. 30, 1974, now U.S. Pat. Nos. 3,933,192. The present invention relates to apparatus for the production of metal ingots, particularly aluminum and aluminium alloy ingots, by the direct chill semi-continuous casting process, that is to say to a process in which ingots are produced by pouring metal into an open-ended mould and applying coolant, usually water, directly to the solidified surface of the metal as it emerges from the mould.

In the production of large rectangular-section ingots for the production of rolled products, it is customary to impart a small amount of convex curvature to the long side walls of the mould to counteract the greater metal shrinkage which take place near the middle of the wide face of the ingot during solidification as compared with locations near the narrow faces of the ingot. By the use of these conventional moulds in which the distance between the wide faces is greatest at their mid-points, the upper parts of the wide faces of the ingot are controlled to an acceptable condition of flatness. However, the butt end of the ingot is formed when the rate of pouring molten metal is relatively low and, as a consequence, in the butt portion of the ingot the wide faces exhibit an undesirable amount of convexity when the above-mentioned conventional moulds are employed. Before an ingot is rolled it is customary to scalp the surface to remove surface defects and thus form a relatively smooth rolling face. The presence of a thick convex butt end frequently makes it necessary to scalp the wide faces of the ingot at the butt end to remove this convexity before a rolling face scalp cut can be made. The presence of the convexity near the butt end also leads to a safety hazard when the unscalped ingots are stacked.

In order to overcome this difficulty, according to the present invention, each wide side wall of a mould for casting a rectangular-section ingot by the D.C. (direct chill) semi-continuous casting process is made flexible and is provided with means for controlling the bowing of the side wall. Such means most conveniently takes the form of a screw jack acting on the side wall at one or more positions symmetrically disposed in relation to the mid-point of the wall, by the operation of which bowing may be progressively applied to the side wall to flex it from an initial flat or slightly bowed condition at the beginning of the casting operation to an appropriately more pronounced bowed contour by the time the maximum dropping rate of the casting table has been reached. Alternatively the bowing function may be performed by hydraulic means. Indeed many other mechanical, electro-mechanical pneumatic devices suggest themselves for this purpose. Whatever expedient is adopted, it is preferred that the device for flexing the mould wall is automatically controlled so that the amount of bowing is kept in step with the rate at which the casting table is lowered.

Each flexible mould wall member is associated with a means for applying sub-mould cooling, i.e., the application of coolant directly to the solidified surface of an ingot emerging from the mould and means are also provided for cooling the mould wall itself. For this purpose the flexible mould wall member may be associated with, but relatively movable in relation to, a water supply conduit, which is formed with at least one aperture in the form of a continuous slit or row of orifices for directing water onto the reverse face of the flexible wall member.

Where the ingot cast is of generally square section or where the difference in dimension between the wider faces and narrower faces is small it may be advantageous for the four wall members, defining the rectangular mould aperture, to be flexible and provided with means for applying a controllable amount of bowing. More usually it is satisfactory for the production of rolling ingots, of which the thickness is relatively small in relation to the wide face, to provide the mould with a pair of rigid end wall members to define the narrow end faces of the ignot. The end wall members may be in the form of conventional water boxes with conventional water-emission slots or jets for the application of sub-mould cooling. These end members may be fixed or may be constructed so as to be movable towards and away from each other. The flexible side wall members of the mould, which define the wide rolling faces of the ingot, preferably take the form of thick strips of metal having high heatconductivity, such as copper or aluminum. Conveniently the side members are about ⅜ inch thick. The means for bowing the side members should be capable of deflecting the middle of the side wall member by up to ½ inch or, in some cases, even more.

Since the flexing of the side wall members is accompanied by a small amount of longitudinal movement in the region of their ends, it is preferable to provide a rubbing seal to maintain the gap between the side members and independently mounted end members at such a value that surface forces prevent the escape of molten metal. In general it is considered that the maintenace of this gap at a value of 1/32 inch or below is sufficient to prevent such escape. In a preferred arrangement, the side wall members are biased against coacting surfaces on the end members and some form of roller bearing device is provided to permit the necessary amount of end movement.

Whilst it is usually preferred that the faces of the opposed side wall members of the mould should be truly parallel to the axis of ingot movement, it may in some instances be desirable to incline them slightly so that the gap between the outlet edges of the side wall members is slightly less than the gap at the inlet edges.

The provision of a mould with flexivle side walls has various advantages in the direct chill continuous casting process. In addition to the primary object of substantially eliminating butt-convexity, it enables ingots of different composition to be cast without change of mould. In conventional practice it is frequently necessary, when casting a different alloy, to change the mould for a mould of different convexity, because of the varying shrinkage characteristics of various alloys and different casting speeds employed. In a construction in which the side wall members and end wall members are separate from each other and the end wall members are movable towards and away from each other, one mould may be employed to cast a full range of ingots of different widths at the rolling face. By employing a series of end members of different facial width, ingots of different thicknesses may be cast with the same apparatus. In some instances a longitudinally tapered ingot may be desired. This may be produced by progressive inward or outward movement of the end members during the casting operation.

In one test ingots 18 inches × 42 inches for the production of aluminium sheet were produced. Various casting speeds and appropriate mould bows produced ingots with flat rolling faces. The following example was one such practice:

Volume of water : 100 gallons per minute
Casting speed : 2¾inches per minute
Metal head : 3 inches
Basin temperature : 680° C
Furnace temperature : 695° C.

Casting started with straight parallel mould side walls and each was bowed out at the rate of 132 inch per 22 seconds until a bow of 12 32 inch per wall or 24 32 inch total bow was obtained.

An ingot of these dimensions, cast in a conventional mould, would have a butt-convexity of approximately ⅜ inch per face. However, as the width is increased, so is the convexity, so that, an ingot 18 inches × 80 inches would have more than ½ inches of convexity.

In other tests casting speeds up to 5 ins./minute have been employed. Very satisfactory results have been obtained at speeds up to 3½inches/minute. As in other D.C. casting procedures, it is found generally preferable to operate with small metal heads so as to ensure minimum delay between cooling by contact with the mould and cooling by means of coolant applied directly to the surface of the ingot below the mould (sub-mould cooling).

In another series of tests ingots for the production of rolled products and having the dimensions 18 inches × 56 inches were cast by the method of the presenrt invention in three different alloys in accordance with the following practices.

| Alloy | Commercial Purity Al | Al-Mn 1% | Al-Mg 1% |
|---|---|---|---|
| Casting Speed | | | |
| Start | 1¾"/min. over 80 seconds | 1¾"/min. over 80 seconds | 1¼"/min. over 80 seconds |
| Increased | to 5"/min. during 180 seconds | to 5"/min. during 180 seconds | to 4¾"/min. during 180 seconds |
| Water Volume | | | |
| Start | 165 gal./min/ over 80 seconds | 165 gal./min. over 80 seconds | 125 gal./min. over 80 seconds |
| Increased | to 200 gal./min. during 180 secs. | to 200 gal./min. during 180 secs. | to 200 gal./min. during 180 secs. |
| Mode of Applicaton | | | |
| Constant during | 70 seconds | 70 seconds | 90 seconds |
| Changed during | 90 seconds | 90 seconds | 90 seconds |
| to pulsed on-off | | | |
| Cycle | 2 seconds | 2 seconds | 2 seconds |
| % off | 50% | 50% | 50% |
| Metal Head in Mould | 1¾ to 2⅛ ins. | 1¾ to 2⅛ ins. | 1¾ to 2⅛ ins. |
| Metal Temperature | 690 ± 5° C | 690 ± 5° C | 690 ± 5° C |
| Mould Opening Start | 100 secs. after casting start | 100 secs. after casting start | 120 secs. after casting start |
| Mould Opening Rate | ⅛"/min. per face for 7 mins. | ⅛"/min. per face for 7 mins. | ⅛"/min. per face for 7mins. |

The ingots produced in these tests had acceptably flat surfaces at their butt ends.

The procedure of the present invention may be employed in conjunction with the procedure in U.S. Pat. No. 3,326,270, in which the uppper parts of the mould surfaces of a continuous casting mould are lined with a flexible thermal insulation sheet material.

We have found that a particular advantage of the present invention is that it enables the shape of the ingot to be controlled where it has become necessary to reduce the casting speed. Reduction of casting speed may be required because of unscheduled increase in metal temperature or lack of metal supply. During the slowdown the formation of a convexity in the rolling faces of the ingot sides can be avoided by reducing the bow in the mould walls.

Referring now to the accompanying drawings:

FIG. 1 is a plan view of one form of mould constructed in accordance with the present invention, FIG. 2 is a section on A—A of FIG. 1, FIG. 3 is a section on B—B of FIG. 1, and FIG. 4 is a section on C—C of FIG. 1.

Although in the description of the accompanying drawings the invention is described with reference to an axially vertical mould, it is to be understood that the principles of the invention may be equally applied to an axially horizontal mould.

In the apparatus shown in FIGS. 1 to 4, the mould is provided with a co-operating stool, carrying a stool cap 2 and supported on a vertically movable base plate 3. The stool cap 2 initially closes the outlet end of the axially vertical mould in the conventional manner.

The mould is connected to and supported by a surrounding frame 4, which also constitutes a water header circuit. The mould itself is constituted by side wall members 5 and end wall members 6. Water jackets 7 extend substantially parallel to and serve to support the side wall members 5 and communicate with the water header conduit 4. The end wall members 6 (FIG. 3) are in the form of a simple water box, having an outlet slit 8 for directing water for sub-mould cooling. A flexible hose 9 connects the water box 6 with the header conduit 4. In this instance the end wall members 6 are stationary, being secured by studs 11 to cross members 10 connected between the water jackets 7. However, the end wall members 6 could be mounted so as to be longitudinally movable on guides by simple modification of the structure. This would permit variation of the width of the side faces of the ingot produced in the mould.

The side wall members 5 each consist of a thick strip of a heat conductive metal, preferably aluminum or copper, which is supported by a pair of links 12, slidably mounted in the wall of the water jacket 7, as shown in FIG. 2. The links 12 are connected to the side wall members 5 through swivel pins 14. At their outer ends the links 12 are connected to a yoke bar 15. The bowing or flexure of the side wall member is effected by means of a manually-actuating screw jack device 16, connected between the yoke bar 15 and an anchorage 17 on the frame 4. The amount of flexure is indicated by the co-operation of a pointer 18 and a scale 19 inscribed on the yoke bar 15. In order to achieve flexure of the side wall members 5 the ends of these members are restrained against outward movement by rollers 20 carried on brackets 21, which are adjustably secured to the end of wall members 6 so as to permit adjustment of the width of the space between a roller 20 and the adjacent vertical edge of an end wall member 6. It will be noted also from FIG. 4 that the side wall members 5 are slidingly supported on guides 22 secured to end wall members 6.

The system for the application of coolant to the side wall members 5 and for the associated sub-mould cooling of the wide faces of the ingot is shown in FIG. 2. This consists of the already-mentioned water jacket 7, which has a series of closely spaced orifices 23, which are arranged to direct water somewhat downwardly onto the reverse face of the side wall member 5. A deflector 24 is secured to the front of the water jacket 7 to check upward movement of water. The space between the side wall member 5 and water jacket 7 is closed off at the top by flexible sliding seal members 25 and 26, the water being free to escape downwardly after impinging on the reverse surface of side wall member 5 to perform its cooling function. The sub-mould cooling is achieved by the use of a spray pipe 27, having a series of orifices 28 positioned to direct water jets very close to the edge of the side wall member 5. The spray pipe 27 draws water from the water heater conduit 4.

In operation the stool cap 2 initially closes the bottom of the mould cavity defined by the end wall members 6 and side wall members 5. At this stage the side wall members 5 are substantially unflexed so that the mould cavity has a substantially rectangular cross-section. The pouring of metal is then commenced and the lowering of the stool 1 is then performed in a conventional manner, that is to say, initially slowly during the formation of the butt end and then more rapidly. As the dropping rate of the stool 1 is increased the screw jack 16 is actuated to apply an amount of flexure which is dependent on the dropping rate and the characteristics of the metal being cast.

It will be understood that the stool constitutes the means for withdrawing the ingot from the mould and would be replaced by other conventional structures when a mould in accordance with the invention is arranged with its axis in a horizontal or inclined position.

It will be appreciated that the supply of metal to the mould may be effected in any convenient way, i.e. via a conventional float-controlled dip tube or other conventional metal feeding devices employed in the art to maintain a substantially constant metal head during the casting operation.

We claim:

1. For use in apparatus for continuously casting a substantially rectangular ingot, a. a rectangular mould for receiving and containing a supply of molten metal, said mould having an open outlet end and side walls formed of heat-conductive metal, at least the long side walls of the mould being curvable, for substantially their full extent in the direction of advance of metal through the mould to and including their margins at the outlet end of the mould, about an axis of curvature parallel to said last-mentioned direction;

b. means for applying coolant liquid to the walls of the mould around its periphery; and c. means for progressively curving at least said long side walls convexly outwardly about said axis.

2. In apparatus for continuously casting a substantially rectangular section ingot in combination a. a rectangular mould adapted to receive and contain a supply of molten metal, said mould having an open outlet end and side walls formed of heat conductive metal, b. means for initially closing the open outlet end of the mould and for progressively withdrawing an ingot from said mould at a controllably variable rate as the surface portion of said ingot solidifies, c. means for applying coolant liquid to the walls of the mould around its periphery to cool the walls, d. means for applying coolant liquid direct to the surface of the emerging ingot at a position adjacent the outlet end of said mould, the e. means for progressively curving at least the long side walls of said mould convexly outwardly, about an axis of curvature parallel to the direction of advance of metal through the mould, during the performance of the casting operation, each of said side walls being curvable about said axis throughout substantially its full cooled extent in said last-mentioned direction to and including the margin of the side wall at the mould outlet end.

3. Apparatus according to claim 2 in which each of the long side walls of the mould is formed of essentially strip form flexible metal, associated with means for applying a flexing force thereto arranged symmetrically with regard to the mid-point of said side wall, the ends of the side walls being restrained from transverse movement.

4. Apparatus according to claim 3 in which the short end walls of said mould are independent of said side walls and a rubbing seal is provided between said fixed end walls and the ends of said side walls.

5. Apparatus according to claim 3 in which the long side walls and the end walls of said mould are formed into a unitary structure.

6. Apparatus according to claim 2, further including means for applying a flexing force to each long side wall of said mould at a plurality of points arranged symetrically in relation to the mid-point of such long side wall.

7. Apparatus according to claim 2, in which said mould comprises a pair of vertically stationary parallel end wall members and a pair of vertically stationary side wall members, arranged substantially perpendicular to the planes of said end wall members, the inner faces of said side wall members being arranged in close proximity to the vertical edges of said end wall members, means associated with said end wall members restraining the end portions of said side wall members against movement away from said vertical edges in the planes of said end wall members but permitting movement in a direction substantially perpendicular to said planes and jack means for applying a horizontal outward force to each of said side wall members at one or more points arranged symmetrically in relation to the mid-point of each of said side wall members.

8. Apparatus according to claim 7, further including means for moving said end wall members towards and away from each other in the horizontal direction.

* * * * *

UNITED STATES PATENT AND TRADEMARK OFFICE

CERTIFICATE OF CORRECTION

PATENT NO. : 4,030,536

DATED : June 21, 1977

INVENTOR(S) : William Simon Rodenchuk et al.

It is certified that error appears in the above-identified patent and that said Letters Patent are hereby corrected as shown below:

Column 1, line 18, "take" should read --takes-- ;
line 19, "face" should read --faces-- .

Column 2, line 22, "heatconductivity" should read --heat conductivity-- ;
line 46, "flexivle" should read --flexible-- .

Column 3, line 11, "132" should read --1/32-- ;
line 12, "12 32" and "24 32" should read --12/32-- and --24/32-- respectively.
line 18, "inches" should read --inch-- ;
line 21, "3-1/2inches" should read -- 3-3/4 inches-- ;
line 30, "presenrt" should read --present--;
line 60, "uppper" should read --upper-- .

Column 5, line 7, before "wall" delete "of" ;
line 30, "heater" should read --header-- .

Column 6, line 19, after "mould," "the" should read

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*